United States Patent [19]

Jürgens

[11] Patent Number: 4,497,224

[45] Date of Patent: Feb. 5, 1985

[54] APPARATUS FOR MAKING AND BREAKING SCREW COUPLINGS

[75] Inventor: Reiner Jürgens, Celle-Osterloh, Fed. Rep. of Germany

[73] Assignee: Norton Christensen, Inc., Salt Lake City, Utah

[21] Appl. No.: 522,123

[22] Filed: Aug. 11, 1983

[51] Int. Cl.[3] ..... B25B 17/00

[52] U.S. Cl. ..... 81/57.34; 81/57.16

[58] Field of Search ..... 81/57.16, 57.19, 57.34; 29/240

[56] References Cited

U.S. PATENT DOCUMENTS 3,256,757 6/1966 Kochaver ..... 81/57.34

4,092,881 6/1978 Jurgens et al. ..... 81/57.34

4,445,402 5/1984 Farr et al. ..... 81/57.16

FOREIGN PATENT DOCUMENTS 2128362 6/1971 Fed. Rep. of Germany .

*Primary Examiner*—James L. Jones, Jr.

*Attorney, Agent, or Firm*—Walter Fred

[57] ABSTRACT

Apparatus for making and breaking screw couplings between pipe members of pipe and drilling strings, includes a rotatable chuck (9) and a fixed chuck (17), the rotatable chuck being provided with a fluid reservoir (111) which maintains the pressure in the pressure-fluid-actuated chuck so that continuous rotary movement of the chuck by a torque-producer (100) is possible for the complete screwing or unscrewing of the coupling.

4 Claims, 5 Drawing Figures

APPARATUS FOR MAKING AND BREAKING SCREW COUPLINGS

TECHNICAL FIELD

The invention relates to an apparatus for making and breaking screw couplings or connections between pipe members of pipes and pipe strings as well as drilling tools for deep-well drilling.

BACKGROUND ART

In such a similar apparatus which is disclosed in U.S. Pat. No. 4,092,881 and corresponding German patent DE No. 2618877, the torque is provided exclusively by a pair of rotary drive cylinders which are disposed diametrically with respect to the main axis of the apparatus and can be actuated in the same direction to impart a limited rotary motion, in intermittent succession, to the rotatable chuck. Flexible pressure fluid lines lead from the source of fluid under pressure to the cylinders. Because the angle of rotation of the rotary motion of the rotatable chuck is predetermined and limited by the stroke of the rotary drive cylinders, the gripping engagement with the pipe member being turned must be released after each step of the rotary motion and be re-established again after the chuck has been turned back. This leads to an increased expenditure of time for carrying out the work of making or breaking a connection and many drilling tools comprise a plurality of connections. Another apparatus serving to make and break screw couplings or connections is also known and disclosed in German publication DE-AS No. 21 28 362, which uses a motor for the drive of the rotatable chuck, which motor engages with a pinion in a toothed rim mounted on the chuck. During the rotation of the rotatable chuck, the associated gripping apparatus remains connected to the pressure fluid source by a sealed rotary connection. Such rotary connections are expensive and susceptible to wear, require very narrow tolerances in size during manufacture and restrict the range of use of the apparatus to pipe members with small diameters. In addition, they can only be used for comparatively low working pressures because of the presence of moving seals and the tendency of the coaxial parts to be sealed with respect to one another to contract and expand when acted upon by pressure.

It is the object of the invention to provide apparatus for making and breaking screw couplings which ensures, with simple structural means, a rapid and reliable operation even when pipe members of large diameter are involved.

SUMMARY OF THE INVENTION

The present invention is apparatus for making and breaking screw couplings or connections between pipe members of pipe and drilling strings as well as drilling tools for deep-well drilling, comprising a rotatable chuck and a fixed (non-rotatable) chuck which jointly are axially aligned and define a main axis of the apparatus and are actuated by pressure fluid, each for receiving one of two pipe members with threaded regions at the ends thereof adjacent to one another. One chuck is mounted in a stationary bearing block secured at one end of a frame of the apparatus, the other chuck being disposed on a supporting block which is displaceable towards and away from the stationary bearing block, and is guided along the frame by an elongated supporting beam which is aligned parallel to the main axis of the apparatus and predetermines the path of movement for the displaceable supporting block and chuck thereon. Each chuck comprises a plurality of gripping units which are uniformly distributed round the main axis of the apparatus and act radially and each of which units comprises a cylinder with a fluid-pressure-actuated piston guided therein and a non-rotatable piston rod and end thereof which faces the pipe members to be gripped, and wherein the cylinders of the gripping units are constructed in the form of double-acting separate structural units each of which comprises a grip pressure and a release pressure compartment which can be acted upon from a common source of fluid under pressure via fluid-pressure lines, and of a torque producer for rotation of the rotatable chuck in relation to the fixed (non-rotatable) chuck during gripping engagement with the pipe members. The torque producer comprises at least one motor which is in engagement, via a pinion with a rotating toothed rim disposed on the rotatable chuck, that the grip pressure compartments of the gripping units of the rotatable chuck are connected to a pressure-retaining reservoir disposed on the rotatable chuck on which is also provided a coupling device by means of which parts of the pressure fluid lines leading to the cylinders can be separated from parts of the pressure fluid lines leading to the source of fluid under pressure, and which comprises non-return valves for shutting off the ends of separated pressure-fluid lines.

The apparatus according to the invention manages with simple structural means because only static seals are needed for the sealing of the separable parts of the pipelines. In contrast to moving seals, these are distinguished by cheap production, high loading capacity and long life and so contribute to the reliability of the whole apparatus. The apparatus according to the invention is also equally suitable for all pipe diameters in question because no parameters specific to size impair the mode of operation.

In order to reduce further the time needed for screwing and unscrewing, two or more pressure-fluid motors may be used as torque producers which are connected in series to the pressure fluid source without substantial counter moment during the screwing and unscrewing and then develop a higher speed of rotation or can be switched over in parallel to the pressure fluid source during the making and breaking and can deliver a higher torque with a reduced speed of rotation.

BRIEF DESCRIPTION OF DRAWINGS

Embodiments of the present invention will now be described, by way of example, with reference to the accompanying drawings, in which.

DESCRIPTION OF THE PREFERRED EMBODIMENT(S)

Figure 1:
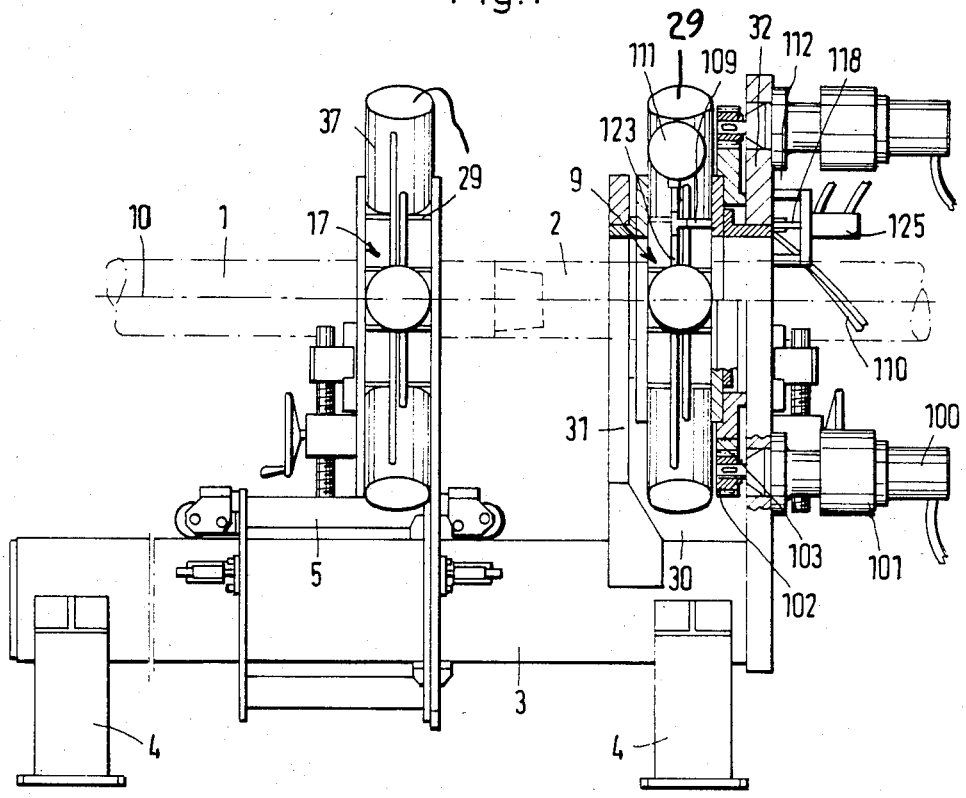
FIG. 1 is a side view of an apparatus according to the invention.

Apparatus, according to the present invention, for making and breaking screw couplings or connections between two pipe members 1 and 2 comprises a frame including a torsion-resistant supporting beam 3 which is constructed in the form of a hollow section member with a rectangular cross-section and is spaced, by means of supports 4 at the ends, from a supporting surface which, with the preferred horizontal installation of the apparatus as illustrated, is formed on the ground by the ground surface. A supporting block 5, which mounts a fixed chuck 17, i.e. held against rotation, in the region of a passage for the pipe member 1, comprises, in its lower region, a rectangular passage which receives the supporting beam 3 and fits closely thereabout. The supporting block 5 is displaceable along the supporting beam 3 which has a length of about 3 meters (9.8') for example, towards and away from a chuck 9 fixed at an end region of the supporting beam 3 with regard to a translatory movement, but rotatable in a stationary supporting block 30. It is also possible to have the supporting block 5 with the fixed (non-rotatable) chuck 17 fixed on the beam and the supporting block 30 with the rotatable chuck 9 displaceable along the beam. The rotatable chuck 9 is mounted between two parallel supporting cheeks 31 and 32 disposed spaced apart and fixed on the beam 3.

A torque producer is provided for rotation of the rotatable chuck 9 in relaion to the fixed chuck 17, the two axially aligned and spaced chucks together defining a main axis 10 of the apparatus with which the axes of the pipe members 1 and 2 coincide when gripped in the apparatus. This torque producer is formed from two motors 100 which are rotatably driven by pressure fluid and which are flange-mounted on the supporting cheek 32. They engage, by means of a pinion 102, a toothed rim or ring gear 103 which is provided on the rotatable chuck 9. The motors 100 may, in turn, be provided with a gear 101 which serves to adapt the torque delivered to that necessary for making and breaking. The motors can be connected in series or in parallel with the pressure fluid source by means of a suitable control unit not illustrated. The actuation of the torque producer to make or break a screw coupling is effected with the chucks in gripping engagement with the pipe members 1, 2, while the supporting block 5 bears with the edges of its passage against the supporting beam 3 in order to support it firmly on the supporting beam and the appearance of transverse forces or other resulting forces acting towards the outside, which might lead to a twisting of the pipe members 1, 2, are avoided by the rotation of the chuck 9 in the same direction.

Figure 3:
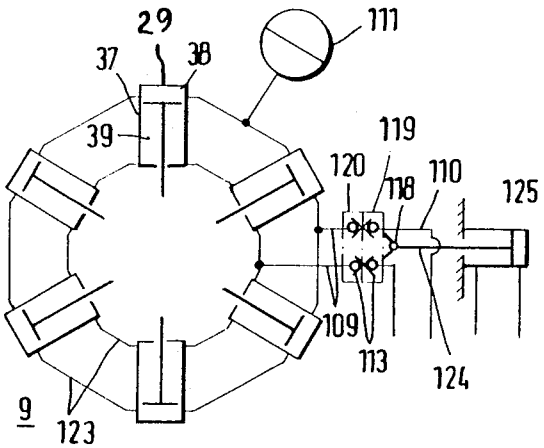
FIG. 3 is a schematic diagram of the hydraulic circuit.
Figure 2B:
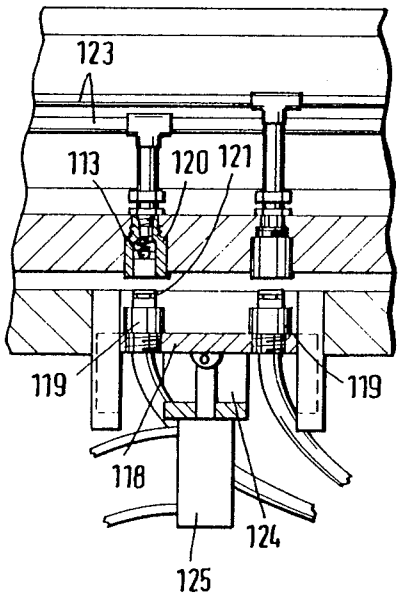
FIG. 2*b* is an enlarged sectional detailed view of the coupling device disconnecting the fluid pressure lines.
Figure 2A:
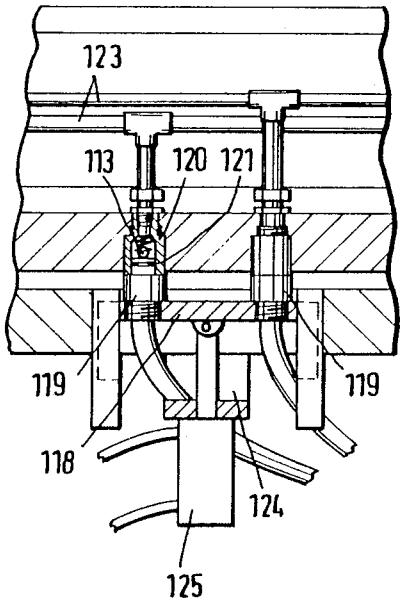
FIG. 2*a* is an enlarged sectional detailed view of the coupling device connecting the fluid pressure lines.

The chucks 9 and 17 are provided with a plurality of gripping units 29, preferably six each, which are distributed uniformly around the main axis 10 of the apparatus as shown in FIG. 3. Each gripping unit 29 comprises a double-acting cylinder 37 which guides a piston and comprises a grip pressure compartment 38 and a release pressure compartment 39 separated by the piston. Connected to the piston by a piston rod is a conventional chuck jaw (not shown) which is guided, secured against rotation, in chucks 9, 17 and is pressed against the surface of the pipe member 1, 2 for the gripping engagement therewith and which is similar to the construction shown in U.S. Pat. No. 4,092,881.

The cylinders 37 are connected to a pressure fluid source via pressure fluid lines. The parts 109 of the pressure fluid lines leading to the cylinders 37 and the parts 110 of the pressure fluid lines leading to the pressure fluid source are connected via a coupling device 112, as shown in detail in FIGS. *2a* and *2b*. Disposed on the rotatable chuck 9, between two cylinders 37, is a pressure retaining reservoir 111 which is connected to the grip pressure compartments 38 of the cylinders 37 via a ring conduit 123. The parts 109 of the pressure fluid lines leading to the cylinders 37 end in bush-like end pieces 120 at the coupling device 112 and are provided with non-return valves 113. A ram 118 provided with plugs 119 is disposed on the supporting cheek 32. The plugs 119 represent the ends of the parts 110 of the pressure fluid lines leading to the pressure fluid source and likewise have non-return valves 113. When these plugs 119 are in alignment with the bush-like end pieces 120 on the chuck 9, these can be connected by means of the ram 118. The ram 118 is actuated via a piston rod 124 which is mounted for movement in a pressure cylinder 125. In the position shown in FIG. *2a*, the lines are connected whereas they are separated as shown in FIG. *2b*. The plugs 119 are equipped with push rods which forcibly open the non-return valves 113 in the connected state and have sealing rings 121 for the sealing between the outer shell of the plug and the inner shell of the bush.

The detail from the hydraulic circuit diagram illustrated in FIG. 3 relates to the rotatable chuck 9 and the coupling device 112. Here the connection between the grip pressure compartments 38 and the release pressure chambers 39 of the cylinders 37 with the coupling device 112 can be seen as well as the arrangement of the pressure retaining reservoir 111. Furthermore, the shut-off direction of the non-return valves is symbolized as well as the drive principle of the ram 118 movable in translation by the pressure cylinder 125.

Figure 4:
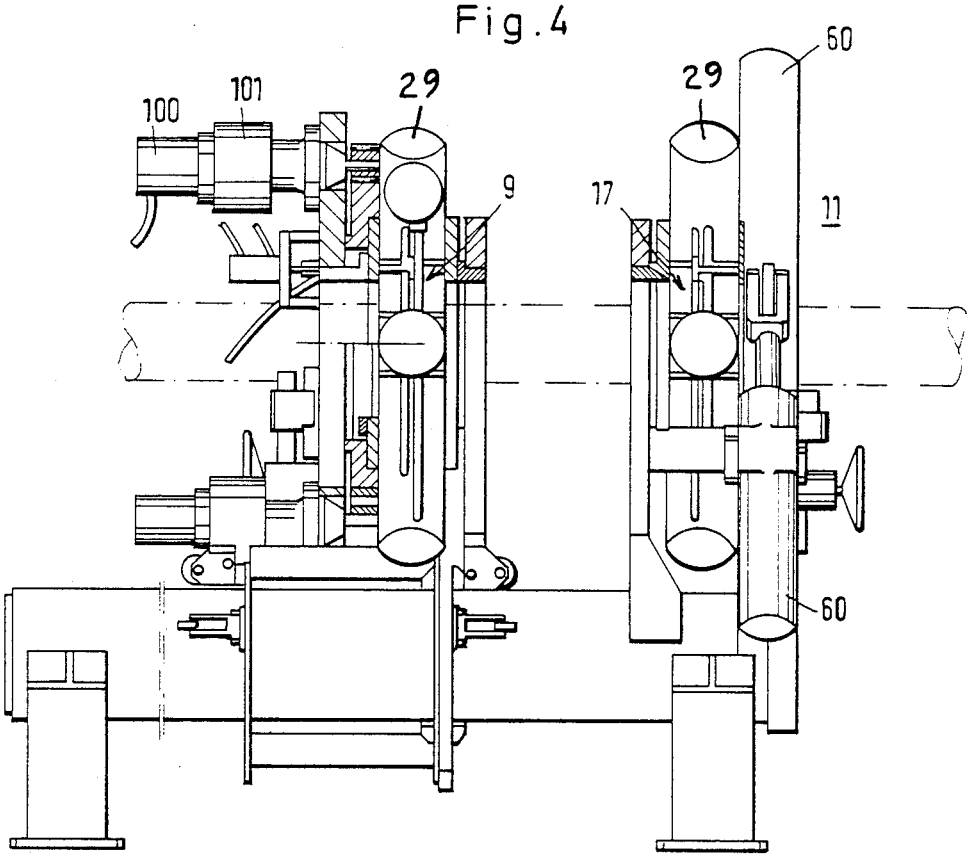
FIG. 4 is a side view of another apparatus comprising a combination of apparatus according to the invention with known apparatus.

According to FIG. 4, the apparatus according to the invention can also be combined with known apparatus such as disclosed in the above mentioned U.S. Pat. No. 4,092,881 to which reference may be had for details not disclosed herein. In such a combination the motor-driven torque producer 100 is made so that it can be locked against rotation and the rotary lock normally holding the chuck 17 against rotation is made unlockable and is provided with a known torque producer consisting of rotary drive cylinders 60 disposed diametrically in relation to the main axis 10 of the apparatus for rotating the unlocked chuck 17. Insofar as the torques which can be applied by the motor-driven torque producer should not be sufficient for the making and breaking, the apparatus can briefly be used in the known form and manner for this operation whereas there is a change over to the apparatus according to the invention in order to execute the continuous rotary movement during the screwing and unscrewing of the connection. The rational mode of operation is retained because the gripping engagement does not have to be loosened but only the locking states of the chucks have to be changed.

I claim:

1. Apparatus for making and breaking screw couplings between pipe members of pipe and drilling strings as well as drilling tools for deep-well drilling, comprising:

a rotatable chuck and a non-rotatable chuck which jointly define a main axis of the apparatus and are actuated by pressure fluid, each chuck adapted for receiving one of two pipe members with threaded regions at their ends adjacent to one another, one chuck being mounted in a bearing block secured at one end of a frame including an elongated supporting beam of the apparatus, the other chuck being disposed on a supporting block which is displaceable towards and away from the stationary bearing block and guided along the frame by the elongated supporting beam which is aligned parallel to the main axis of the apparatus and predetermines the path of movement for the supporting block, each chuck comprising a plurality of gripping units which are uniformly distributed round the main axis of the apparatus and act radially and each of the gripping units comprises a cylinder with a pressure-fluid-actuated piston guided therein and a non-rotatable piston rod which faces the pipe members to be gripped, and wherein the cylinders of the gripping units are constructed in the form of double-acting, separate structural units each of which comprises a grip pressure and a release pressure compartment which can be acted upon from a common pressure-fluid source via pressure-fluid lines, and of a torque producer for rotation of the rotatable chuck relative to the non-rotatable chuck during gripping engagement with the pipe members, and wherein the torque producer comprises at least one motor which is in engagment, via pinion with a rotatable toothed rim disposed on the rotatable chuck, that the grip pressure compartments of the gripping units of the rotatable chuck are connected to a pressure-retaining reservoir disposed on the chuck, there being provided on the rotatable chuck a coupling device by means of which parts of the pressure fluid lines leading to the cylinders can be separated from parts of the pressure fluid lines leading to the pressure fluid source, and which comprises non-return valves for shutting off the ends of separated pressure-fluid lines.

2. Apparatus according to claim 1, wherein the coupling device comprises:

a pressure-fluid-operated ram which is disposed on the supporting block for the rotatable chuck and which renders possible a movement towards and away from the chuck, and that, at the rotatable chuck and the ram, the parts of the pressure-fluid lines end at coupling pieces which can be connected and separated in an axially aligned position by means of the ram.

3. Apparatus according to claim 1 wherein the torque producer comprises:

two or more hydraulic motors which can be connectd selectively in series or in parallel with regard to their connection to the pressure-fluid source.

4. Apparatus according to claim 1 wherein the motor-driven torque producer can be locked and the rotatable chuck has an unlockable rotary lock and is provided with a further torque producer consisting of rotary drive cylinders which are disposed diametrically with respect to the main axis of the apparatus and can be actuated in the same direction.

* * * * *